US005086533A

United States Patent [19]

Kitahara

[11] Patent Number: 5,086,533

[45] Date of Patent: Feb. 11, 1992

[54] DEVICE FOR CLEANING A WINDOW GLASS

[75] Inventor: Genichi Kitahara, Tokyo, Japan

[73] Assignee: Nihon Biso Kabushiki Kaisha, Tokyo, Japan

[21] Appl. No.: 700,345

[22] Filed: May 7, 1991

Related U.S. Application Data

[63] Continuation of Ser. No. 380,818, Jul. 17, 1989, abandoned.

[30] Foreign Application Priority Data

Jul. 19, 1988 [JP] Japan ..... 63-95433[U]

[51] Int. Cl.[5] ..... A47L 1/04

[52] U.S. Cl. ..... 15/103; 15/302

[58] Field of Search ..... 15/103, 250.2, 401, 15/370, 50 R, 302, 250.11, 250.42

[56] References Cited

U.S. PATENT DOCUMENTS

| | | | |
|---|---|---|---|
| 2,752,626 | 6/1956 | Oishei | 15/250.20 |
| 3,292,196 | 12/1966 | Windorf | 15/103 |
| 3,999,242 | 12/1976 | Maruyoma et al. | 15/103 |
| 4,198,724 | 4/1980 | Fisher et al. | 15/103 |

*Primary Examiner*—Harvey C. Hornsby
*Assistant Examiner*—Gary K. Graham
*Attorney, Agent, or Firm*—Hedman, Gibson & Costigan

[57] ABSTRACT

A device for cleaning a window glass having a moving unit which is moved along a window of a building and a squeegee capable of removing dust deposited on a window glass by spraying water thereon and thereafter scraping the dust off the window glass comprises a first moving member such as a piston guide having a size corresponding to width of a window glass and being mounted on the moving unit in such a manner that the position of fixing the first moving member to the moving unit can be adjusted so that the first moving member can be located closer to or away from the window glass, a second moving member such as a piston mounted on the first moving member in such a manner that the second moving member can be moved toward and away from the window glass, a gas bag containing pressurized gas and connected to the second moving member to supply a moving force to the second moving member, a third moving member such as squeegee holders mounted on the second moving member in such a manner that the third moving member can be moved toward and away from the window glass, said third moving member being divided in plural members in the direction of the width of cleaning, energizing means such as springs for urging the third moving member toward the window glass, and a squeegee secured to the third moving member.

3 Claims, 4 Drawing Sheets

DEVICE FOR CLEANING A WINDOW GLASS

BACKGROUND OF THE INVENTION

This application is a continuation of application Ser. No. 380818 filed July 17, 1989, now abandoned This invention relates to improvements in a device for cleaning a window glass and, more particularly, to a device of this type having a squeegee capable of removing dust deposited on a window glass by spraying water thereon and thereafter scraping the dust off the window glass.

There has been an increasing tendency to design a higher building with an increase in the number of windows provided in such higher building.

In order to keep window glasses of these windows clean, it is necessary to clean the window glasses regularly. A conventional method for cleaning a window glass of such a high building depends on manual labor by a workman who sprays water on a window glass from a moving scaffold hung from a roof of a building and wipes the window glass by a scraper to recover the soiled water. This conventional method however is inefficient and besides is dangerous.

There has been developed a device for automating the cleaning of window glass. According to this device, as shown in FIG. 3, a pair of vertically disposed scrapers 2 and 3 which abut against a window glass are mounted on a cleaning unit 1 which is hung from the roof of a building and can be moved in the vertical direction and a water spray nozzle 4 is provided between the scrapers 2 and 3. The scrapers 2 and 3 are mounted in such a manner that their position of fixing to the unit 1 can be changed as desired. Water is sprayed from the water spray nozzle 4 over the window glass while the cleaning unit 1 is moved downwardly. By this operation, dust is scraped off the window glass by the upper scraper 2 and collected with soiled water by the lower scraper 3 to be supplied to a soiled water tank (not shown).

For achieving excellent cleaning without leaving a portion which has been left unwiped on the window glass, it is necessary for this type of prior art device to push the pair of scrapers 2 and 3 against the window glass with a constant force. For this purpose, the amount of projection of the scrapers 2 and 3 from the cleaning unit 1 is adjusted by changing the position at which these scrapers 2 and 3 are fixed to the cleaning unit 1 before the cleaning work is started.

Although the cleaning unit 1 is moved downwardly along guides provided on both sides of a window of the building, there is variation in the mounting position of the guides on the window due to error in mounting the guide. This gives rise to the problem that the interval between the surface of the window glass and the cleaning unit 1 does not become constant with a result that the pushing force of the scrapers 2 and 3 is subject to variation.

As a result, there arises the problem that, as shown in FIG. 4, the upper scraper 2 whose optimum position is shown in FIG. 4*a* may become spaced apart from the window glass W as shown in FIG. 4*b*. As a result a portion of the window glass W may remain unwiped. If the pressure on the scrapper is too large there is an increase in the resistance to wiping and production of scratches on the window glass W.

Further, the surface of the window glass W may not necessarily be even but sometimes is flexed due to pushing of the scrapers 2 and 3 against the window glass. The problems of the unwiped portion on the window glass and increase in the resistance in wiping are produced also in the longitudinal direction of the scrapers 2 and 3.

It is, therefore, an object of the invention to provide a device for cleaning a window glass capable of pushing a squeegee against a window glass with a proper constant force over the entire width of the window glass regardless of variation in the distance between the cleaning device and the window glass.

SUMMARY OF THE INVENTION

The device for cleaning a window glass achieving the above described object of the invention has a moving unit which is moved along a window of a building and comprises a first moving member having a size corresponding to width of a window glass and being mounted on the moving unit in such a manner that the position of fixing the first moving member to the moving unit can be adjusted so that the first moving member can be located closer to or away from the window glass, a second moving member mounted on the first moving member in such a manner that the second moving member can be moved toward and away from the window glass, a gas bag containing pressurized gas and connected to the second moving member to supply a moving force to the second moving member, a third moving member mounted on the second moving member in such a manner that the third moving member can be moved toward and away from the window glass, said third moving member being divided into plural members in the direction of the width of cleaning, energizing means for urging the third moving member toward the window glass, and a squeegee secured to the third moving member.

According to the invention, the moving unit which, for example, is hung from a roof car running on the roof of a building and is capable of moving vertically along the building includes the first moving member such as a piston guide having a size corresponding to the width of a window glass. This first moving member is mounted on the moving unit in such a manner that the position of fixing it to the moving unit can be adjusted so that the first moving member can be located closer to or away from the window glass surface. The second moving member such as a piston is mounted on the first moving member so that the second moving member can be moved toward or away from the window glass surface. The second moving member is constantly pushed toward the window glass by action of a gas bag containing pressurized gas such as pressurized air. The third moving member is divided into plural members in the form of, e.g., holders, in the direction of width of cleaning and each of the plural members is urged toward the window glass surface by means of a spring or the like.

The cleaning squeegee is secured to the third moving member. Consequently, the squeegee as a whole is urged toward the window glass surface in the entire width of the squeegee by the force applied by the gas bag whereas respective portions of the squeegee corresponding to the plural members of the third moving member are automatically pushed against the window glass surface with a constant force whereby an excellent cleaning effect on the window glass surface can be obtained.

Accordingly, the cleaning squeegee can be brought into abutting engagement with the window wall surface always in an optimum condition by correcting unevenness or flexion of the window glass surface occurring due to relation between the window glass and the cleaning device or configuration of the window glass surface.

BRIEF DESCRIPTION OF THE DRAWINGS

In the accompanying drawings.

DESCRIPTION OF A PREFERRED EMBODIMENT

Figure 1:
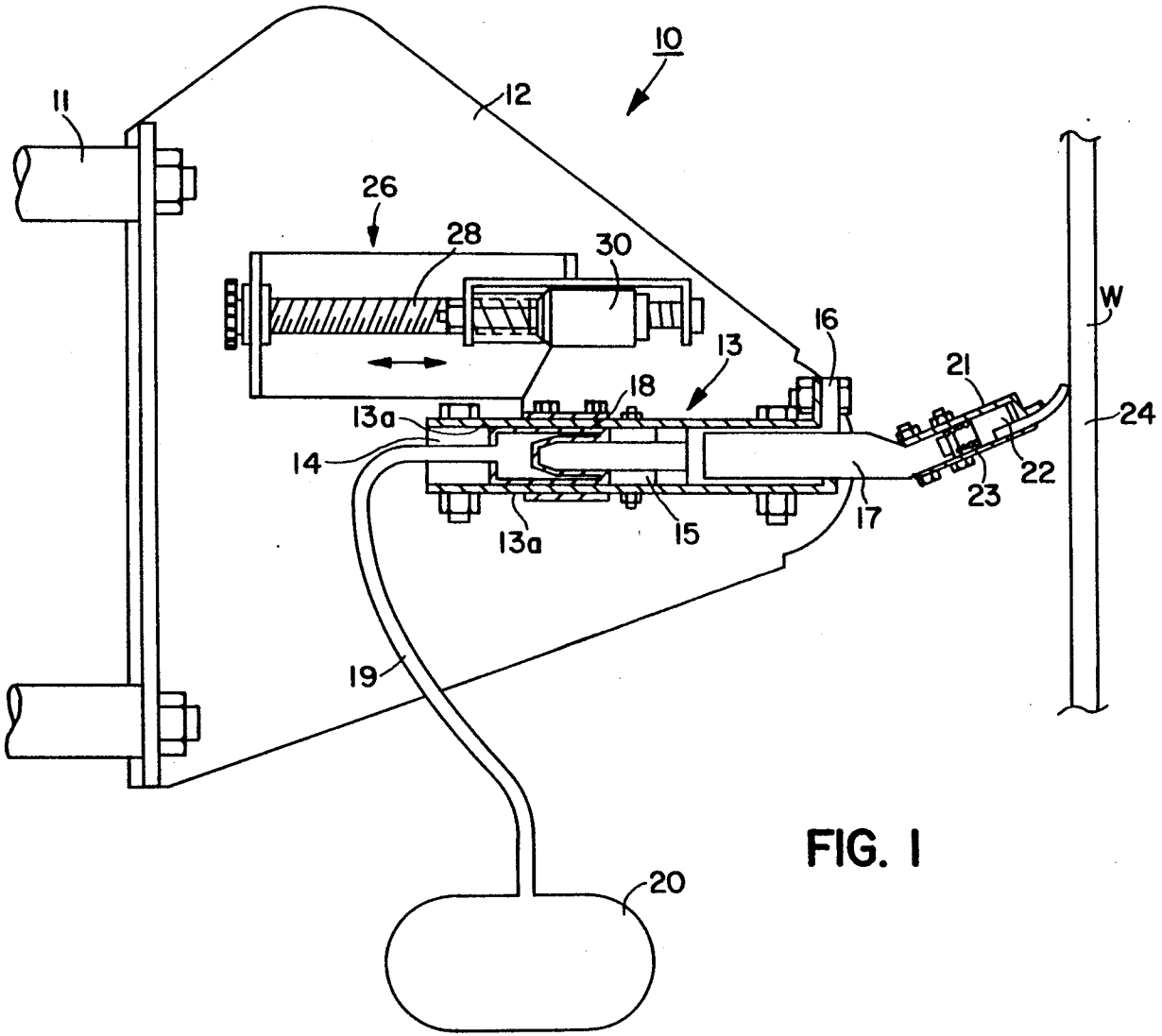
FIG. 1 is a vertical sectional view of an embodiment of the invention.
Figure 2:
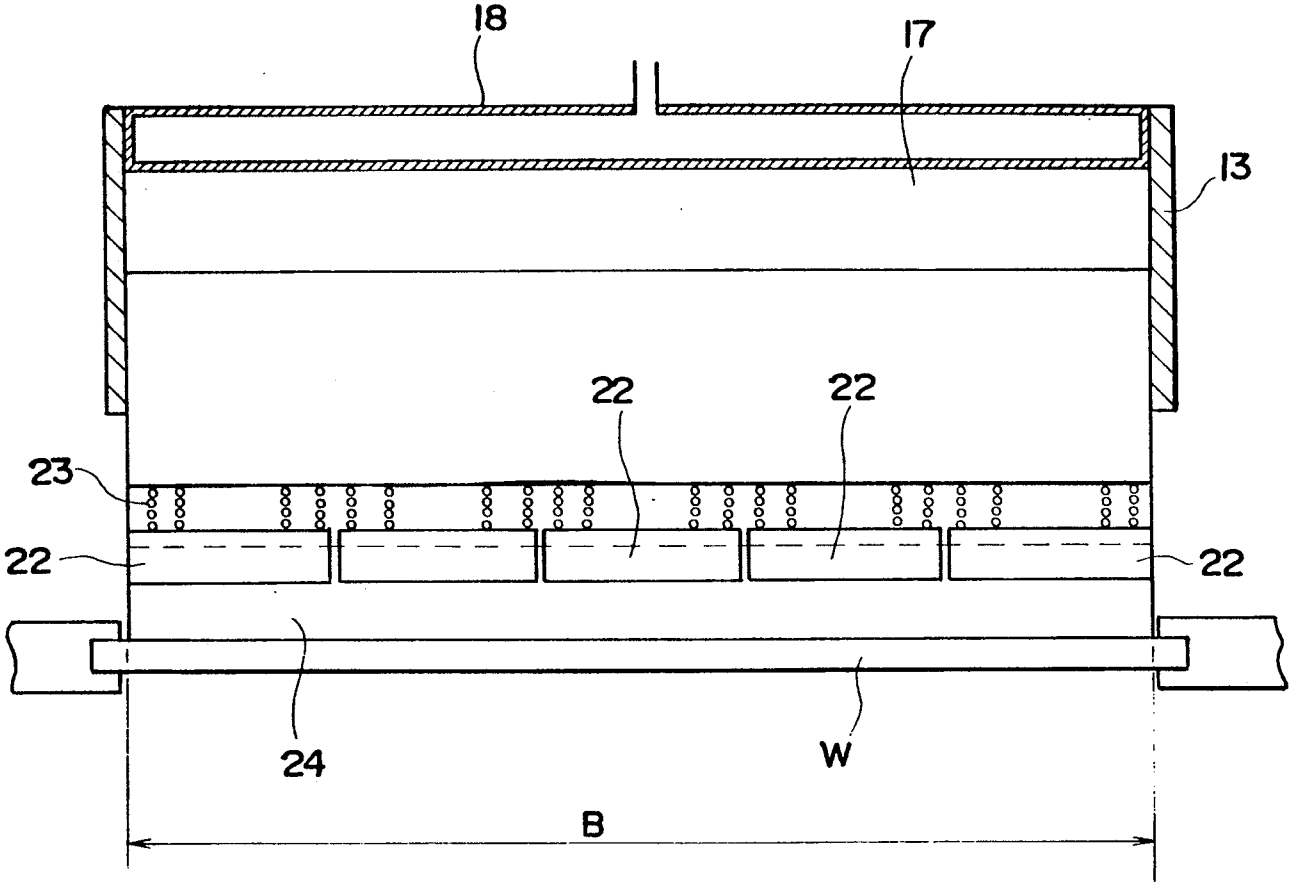
FIG. 2 is a horizontal sectional view of the the embodiment.

An embodiment of the invention will now be described with reference to FIGS. 1 and 2 of the accompanying drawings.

A device 10 for cleaning a window glass comprises a moving unit 11 which is capable of moving to a desired position on an outer wall of a building on which a window glass W is provided. This moving unit 11 is constructed, for example, of an oblong, box-like unit which is moved vertically by means of a couple of wires hung from a roof car running along a rail provided on the roof of the building.

The front portion of this moving unit 11 which opposes the window glass W has a horizontally elongated opening corresponding to the width B (see FIG. 2) of a portion to be cleaned on the window glass W. The front portion also includes a part of the device for cleaning the window glass W including a squeegee 24 to be described later projecting toward the window glass W.

Figure 3:
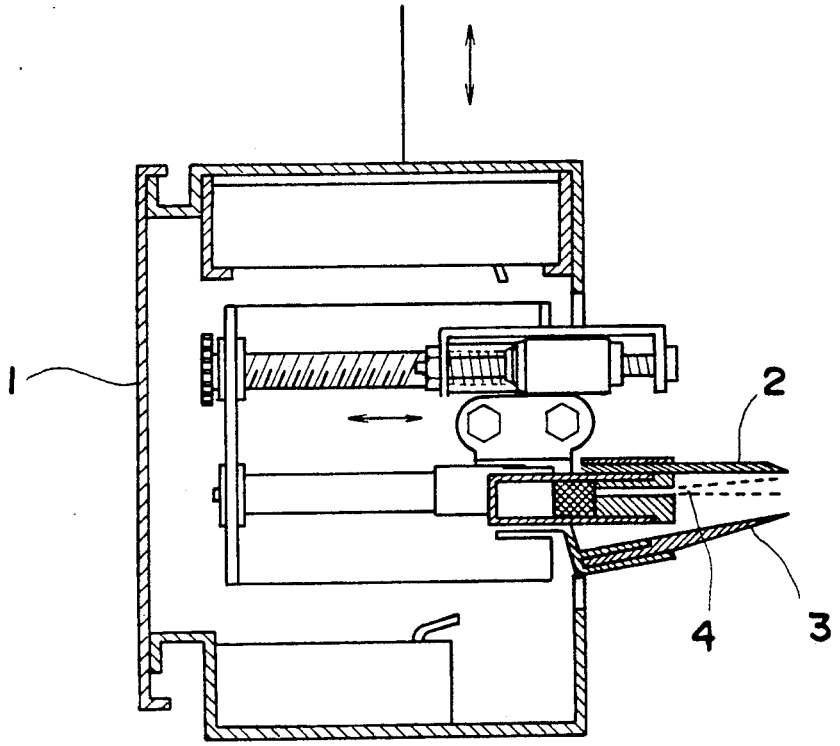
FIG. 3 PRIOR ART
FIG. 3 is a cross sectional view of the prior art cleaning device.
Figure 4A:
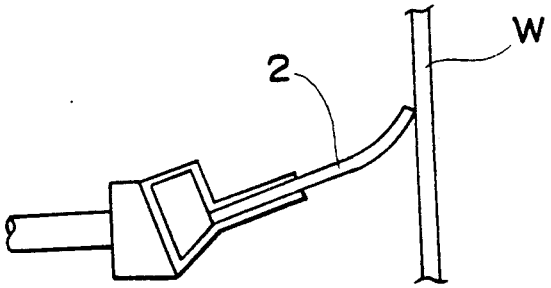
FIGS. 4*a*, 4*b* and 4*c* are views for explaining scraping operation by the prior art cleaning device.
Figure 4B:
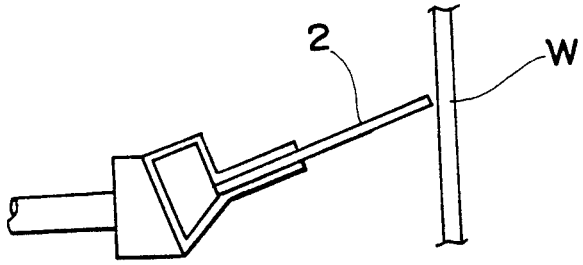
Figure 4C:
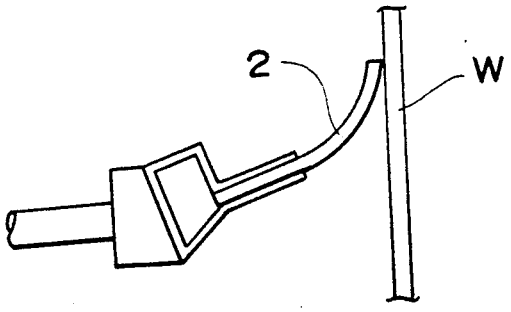
FIG. 4c PRIOR ART

On a support frame 12 there is provided integrally with the moving member 11 a piston guide 13 which constitutes the first moving member. The piston guide 13 includes a pair of vertically arranged guide plates 13*a*, 13*a* which have a width corresponding to the cleaning width B. The position of fixing the piston guide 13 to the support frame 12 can be adjusted by a known, adjustable fixing means so that the distance between the piston guide 13 and the window glass W can be determined at a desired value as illustrated in prior art FIG. 3. More specifically, as shown in FIG. 1, an adjustable fixing means is exemplified as a piston guide moving device 26 which includes a feed screw 28 rotatable by a known drive source (not shown) and a nut 30 fixedly secured to the piston guide 13 and in meshing engagement with the feed screw 28. A spacer 14 is provided at a rear end portion of the piston guide 13 and slide bearings 15 and 16 are provided in the middle and foremost end portions of the piston guide 13. Thus, the piston guide 13 generally has a thin, box-like configuration.

The piston guide 13 has mounted therein a piston 17 which constitutes the second moving member. This piston 17 is slidable inside the piston guide 13 through the slide bearings 15 and 16 toward and away from the window glass W. The foremost end portion of the piston 17 is bent upwardly so as to make a predetermined angle with the window glass W for wiping of the window glass W.

The rear end portion of the piston 17 is enclosed by an air bag 18 which is secured to the inside of the piston guide 13. The inside of the air bag 18 communicates with an air tank 20 via a pipe 19 which is connected to the air bag 18 through the spacer 14 and air under a predetermined pressure is supplied from the air tank 20 to the air bag 18.

The piston 17 therefore is pushed with a predetermined constant force toward the window glass W over the entire cleaning width B.

To the foremost end of the piston 17 is secured a holder guide 21 which is a box-like configuration having a width corresponding to the cleaning width B and encloses the piston 17 therein. A plurality of holders 22 which constitute the third moving member are mounted to the holder guide 21 in such a manner that the holders 22 are arranged in a row in the direction of the cleaning width B. These holders 22 are adapted to be moved within a limited extent in the direction of the cleaning width B. Springs 23 are provided between the foremost end of the piston 17 and the rear end of the respective holders 22 so that the holders are urged toward the window glass W.

Accordingly, the holders 22 can be moved toward and away from the window glass W independently from the piston 17 which is moved integrally in its entire width B. Besides, the holders 22 are provided separately from one another in the direction of the cleaning width B and can be moved toward and away from the window glass W independently from one another.

A cleaning squeegee 24, made integrally of an elastic material such as rubber having a width corresponding to the cleaning width B, is connected at its base portion to the holders 22. The foremost end portion of the squeegee 24 projects out of the holder guide 21 to abut against the window glass W.

In addition to the above described device, other devices necessary for cleaning the windows such as a water spray device and a soiled water recovery device are mounted in the moving unit 11.

The cleaning operation for the window glass W by the cleaning device 10 having the above described construction will now be described.

First, the amount of projection of the piston guide 13 is adjusted and then the piston guide 13 is fixed to the support frame 12. Air under a predetermined pressure is supplied to the air tank 20 so that the pressure inside of the air bag 18 shows a predetermined value.

Then, the moving unit 11 hung from the roof car is moved to a desired location on the wall where the cleaning is needed and the moving unit 11 is mounted on guide rails provided at both sides of the window glass W to be cleaned so that the moving unit 11 is moved vertically along the wall surface.

Preparations for running the devices necessary for the cleaning are made and upon completion of the preparations, the moving unit 11 is moved downwardly while water is sprayed over the window glass W.

Dust on the window glass W is removed from the window glass W by the sprayed water and wiped off by the downward movement of the squeegee 24 which engages the window glass W.

Since the piston 17 is pushed toward the window glass W by air in the air bag 18 and the holders 22 are urged toward the window glass W by the force of the springs 23, if there is a recessed portion in the window glass W, the holder or holders 22 located at this recessed portion project toward the recessed portion to push the squeegee 24 to the window glass W with a constant force.

If, conversely, there is a projecting portion in the window glass W, the squeegee 24 pushes back the piston 17 and the spring 23 whereby the squeegee 24 in this case is also pushed to the window glass W with a constant force.

Since the air bag 18 which pushes the piston 17 can be deformed freely and the holders 22 which are provided separately in the direction of the cleaning width B can be moved independently from one another, if the window glass W is bent as veiwed in its plan (FIG. 2), the holders 22 can push the squeegee 24 which is flexible per se to the window glass W in conformity to the bending of the window glass W.

If the distance between the piston guide 13 and the window glass W is changed, the squeegee 24 supported by the piston 17 is pushed by the air bag 18 with a constant force to engage with the window glass W.

If the squeegee 24 ceases to be parallel with the window glass W, the piston 17 pushed by the air bag 18 changes its position in conformity to the configuration of the window glass W due to the force applied from the squeegee 24 so that the squeegee 24 can be maintained in parallel with the window glass W.

By designing the air tank 20 so that its capacity is sufficiently large, variation in the air pressure occurring when the piston 17 is displaced by the movement of the squeegee 24 can be made negligibly small so that the squeegee 24 can be pushed to the window glass W with a substantially constant force.

Since the squeegee 24 is supported by the springs 23 through the holders 22 which are separated in the cleaning direction B, if the window glass W is bent due to pressing of the squeegee 24 against the window glass W, the amount of projection of the holders 22 can change partially and, in this case also, the squeegee 24 is pushed to the window glass W in the entire width of the squeegee 24.

Thus, in a case where the distance between the support frame 12 and the window glass W has changed, or the squeegee 24 ceases to be parallel with the window glass W, or the window glass W is bent due to pressing of the squeegee 24, such irregularities are corrected by a total action of the three-stage moving members, air bag 18 and springs 23 whereby the squeegee 24 can always be pushed to the window glass W with a constant force to perform an excellent and accurate wiping without leaving an unwiped portion on the window glass W.

In the above described embodiment, an air bag is used as the gas bag but the gas enclosed in the gas bag is not limited to air but other gas may be employed depending upon conditions of use of the cleaning device.

As to the second moving member, this moving member may be either integrally formed or separated in several parts in the direction of the cleaning width B.

What is claimed is:

1. A device for cleaning a window glass having a moving unit which is moved along a window of a building comprising:

a first moving member having a size corresponding to the width of a window glass and being mounted on the moving unit in such a manner that the position of fixing the first moving member to the moving unit can be adjusted so that the first moving member can be located closer to or further away, from the window glass;

a second moving member mounted on the first moving member in such a manner that the second moving member can be moved toward and away from the window glass;

a gas bag containing pressurized gas of a predetermined pressure and connected to the second moving member to supply a moving force to the second moving member;

a third moving member comprising a plurality of squeegee holders arranged in a row in the direction of the width of cleaning, each of the plural squeegee holders being mounted movably on the second moving member and being elongated in the direction of the width of cleaning;

spring means provided between the second moving member and each of the squeegee holders to urge each of the squeegee holders toward the window glass with a uniform force over the entire length of the squeegee holders and to enable each of the squeegee holders to move toward or away from the window glass independently from the second moving member and also independently from the other squeegee holders; and a squeegee secured commonly to said plural squeegee holders.

2. A device as defined in claim 1 wherein said first moving member is a piston guide and said second moving member is a piston fitted in the piston guide.

3. A device as defined in claim 1 wherein the pressurized gas is air.

* * * * *